US009995023B2

(12) United States Patent
DeVries

(10) Patent No.: US 9,995,023 B2
(45) Date of Patent: Jun. 12, 2018

(54) INTEGRAL FINIAL FOR A FAUCET

(71) Applicant: Delta Faucet Company, Indianapolis, IN (US)

(72) Inventor: Adam M. DeVries, Anderson, IN (US)

(73) Assignee: Delta Faucet Company, Indianapolis, IN (US)

( * ) Notice: Subject to any disclaimer, the term of this patent is extended or adjusted under 35 U.S.C. 154(b) by 205 days.

(21) Appl. No.: 14/974,719

(22) Filed: Dec. 18, 2015

(65) Prior Publication Data

US 2016/0208464 A1 Jul. 21, 2016

Related U.S. Application Data

(60) Provisional application No. 62/104,506, filed on Jan. 16, 2015.

(51) Int. Cl.

| | |
|---|---|
| ***F16K 35/14*** | (2006.01) |
| ***E03C 1/04*** | (2006.01) |
| ***E03C 1/23*** | (2006.01) |

(52) U.S. Cl.

CPC ..... *E03C 1/0404* (2013.01); *E03C 1/0412* (2013.01); *E03C 1/2302* (2013.01)

(58) Field of Classification Search

USPC ..... 4/690, 672, 689, 677, 695; 137/801

See application file for complete search history.

(56) References Cited

U.S. PATENT DOCUMENTS

| | | | | |
|---|---|---|---|---|
| 3,967,638 | A | 7/1976 | Tondreau | |
| 5,813,436 | A | 9/1998 | Chen | |
| D434,114 | S | 11/2000 | Green et al. | |
| 6,912,742 | B1 | 7/2005 | Wang | |
| 7,556,061 | B2 | 7/2009 | Morita et al. | |
| 7,886,372 | B2 | 2/2011 | Jacobs | |
| 8,011,384 | B2 | 9/2011 | Izzy et al. | |
| 8,407,828 | B2 | 4/2013 | Vogel et al. | |
| 8,407,829 | B2 | 4/2013 | Vogel et al. | |
| 8,695,625 | B2 | 4/2014 | Marty et al. | |
| 2005/0066440 | A1* | 3/2005 | Fischl | E03C 1/04 4/689 |
| 2006/0180221 | A1 | 8/2006 | Ko | |
| 2009/0139025 | A1* | 6/2009 | Vogel | A47K 1/14 4/689 |
| 2011/0185494 | A1 | 8/2011 | Beck et al. | |
| 2013/0220439 | A1 | 8/2013 | Pitsch et al. | |

FOREIGN PATENT DOCUMENTS

| | | |
|---|---|---|
| CA | 2 576 666 | 8/2008 |

OTHER PUBLICATIONS

American Standard 9259801.295 San Sebastian 8-Inch Two Handle Lavatory Faucet, Satin Nickel; http://www.amazon.com/ American-Standard-9259801-295-Sebastian-Lavatory/dp/B00ARY0561; retrieved on Dec. 5, 2014.

The New York Times; Home Clinic; Is Your Sink Tired? Try a New Faucet: Ward, John, New York Times, Late Edition (East Coast) (New York, NY); Mar. 10, 1991: A.16.; http://search.proquest.com/professional/docview/428006983/1498208A69E69AA3B/2?accountlid=157282; retrieved Dec. 5, 2014.

* cited by examiner

*Primary Examiner* — Lauren Crane

(74) *Attorney, Agent, or Firm* — Faegre Baker Daniels LLP

(57) ABSTRACT

A faucet includes a delivery spout, a lift rod supported by the delivery spout for movement between a lowered position and a raised position, and a finial coupled to the upper end of the lift rod, the finial being configured to conform to the outer surface of the delivery spout when in a lowered position.

28 Claims, 8 Drawing Sheets

INTEGRAL FINIAL FOR A FAUCET

CROSS-REFERENCE OR RELATED APPLICATION

This application claims priority to U.S. Provisional Patent Application Ser. No. 62/104,506, filed Jan. 16, 2015, the disclosure of which is expressly incorporated herein by reference.

BACKGROUND AND SUMMARY OF THE DISCLOSURE

The present invention relates generally to faucets and, more particularly, a faucet including a finial coupled to a lift rod for operating a drain assembly.

Conventional lavatory faucets are often coupled to a pop-up drain assembly. Such drain assemblies typically include a pull or lift rod extending in a generally vertical direction from below the sink deck upwardly to a position above the faucet. A lower end of the lift rod is usually coupled to a lever arm wherein raising and lowering of the lift rod by a user from above the sink deck causes corresponding pivoting movement of the lever arm to raise and lower a drain plug positioned within the sink basin.

A knob or finial is typically coupled to the upper end of the lift rod to facilitate access by a user. It is desired to provide an aesthetically pleasing finial that is completely received within the interior of the faucet when in a lowered position, and is visible to a user when in a raised position.

According to an illustrative embodiment of the present disclosure, a faucet includes a delivery spout configured to be coupled to a mounting deck, the delivery spout including an upper surface and an outlet for dispensing water. A lift rod is supported by the delivery spout for movement between a lowered position and a raised position. The lift rod includes an upper end and a lower end. A finial is coupled to the upper end of the lift rod and includes an upper surface. The upper surface of the finial is supported above the upper surface of the delivery spout when the lift rod is in the raised position. The upper surface of the finial is supported flush with or below the upper surface of the delivery spout when the lift rod is in the lowered position.

According to another illustrative embodiment of the present disclosure, a faucet includes a delivery spout configured to be coupled to a mounting deck. The delivery spout includes an outer surface defining an outer envelope. A lift rod is supported by the delivery spout for movement between a lowered position and a raised position. The lift rod includes an upper end and a lower end. A finial is coupled to the upper end of the lift rod and includes an outer surface. The outer surface of the finial extends outside of the outer envelope of the delivery spout when the lift rod is in the raised position. The outer surface of the finial is supported within the outer envelope of the delivery spout when the lift rod is in the lowered position.

According to a further illustrative embodiment of the present disclosure, a faucet includes a delivery spout configured to be coupled to a mounting deck, the delivery spout including an upper surface, a rear surface, a slot formed within the rear surface, and an outlet for dispensing water. A lift rod is supported by the delivery spout for movement between a lowered position and a raised position. The lift rod includes an upper end and a lower end. A finial is coupled to the upper end of the lift rod. The finial is slidably received within the slot of the delivery spout. The finial is fully received within the slot when the lift rod is in the lowered position, and extends outwardly from the slot when the lift rod is in the raised position.

Further illustratively, the finial includes an upper surface and a rear surface. The upper surface of the finial is supported above the upper surface of the delivery spout when the lift rod is in the raised position. The upper surface of the finial is supported flush with or below the upper surface of the delivery spout when the lift rod is in the lowered position.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1:
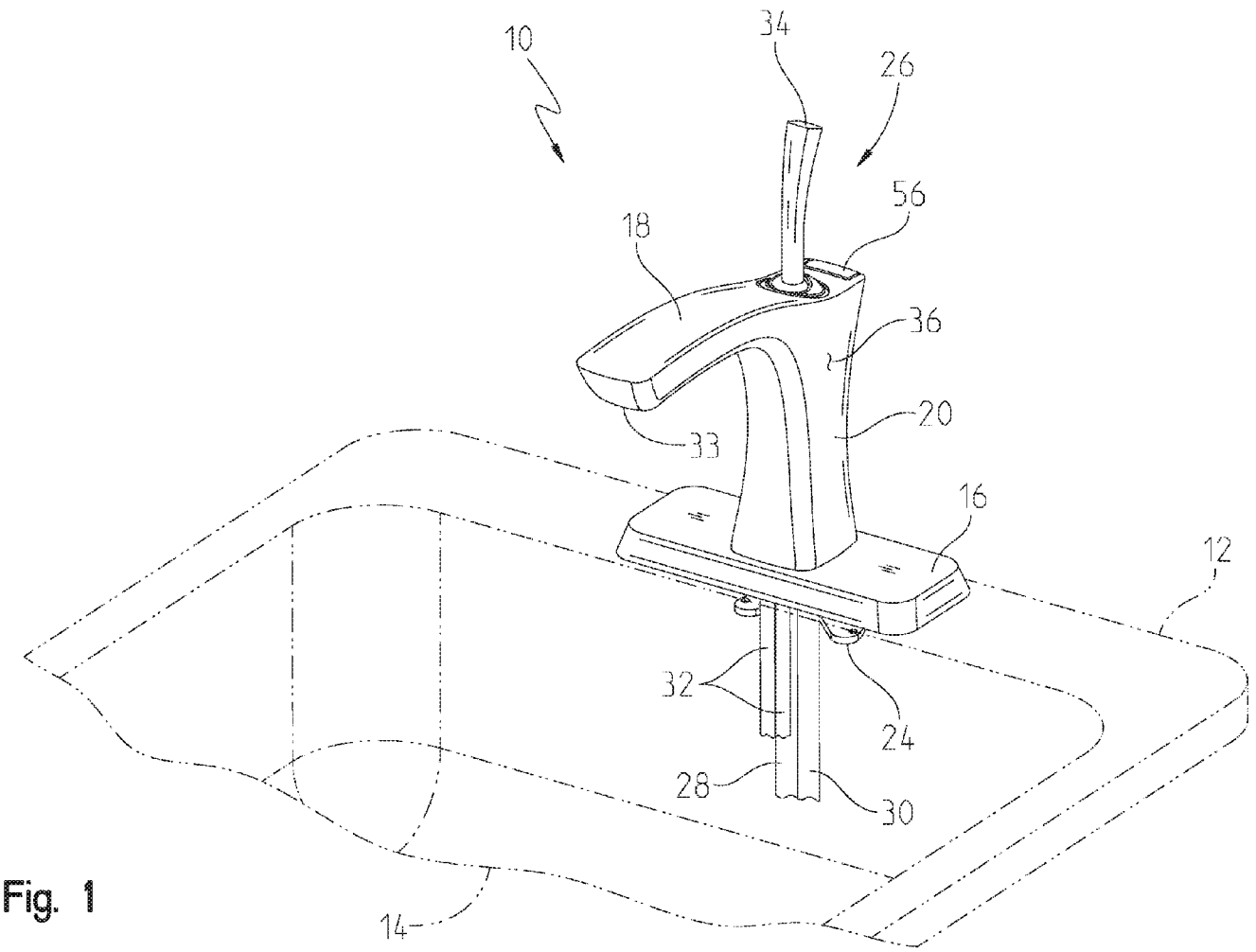
FIG. 1 is a front perspective view of an illustrative faucet mounted on a sink deck.
Figure 2:
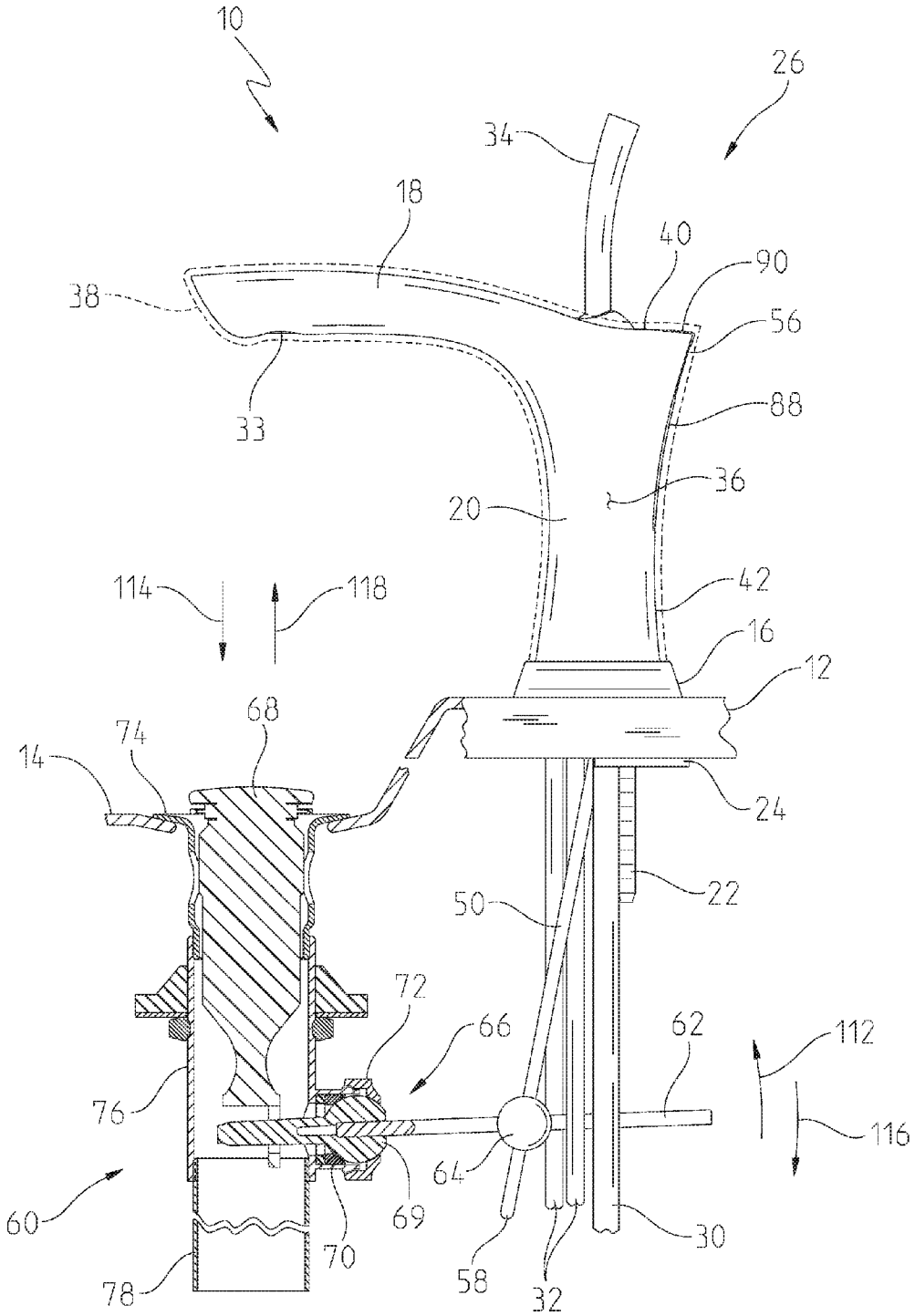
FIG. 2 is a side elevational view, in partial cross-section, of the illustrative faucet of FIG. 1 coupled to a pop-up drain assembly.

Referring initially to FIGS. 1 and 2, an illustrative embodiment faucet 10 is shown positioned above a mounting base, illustratively a mounting or sink deck 12 supporting a sink basin 14. The faucet 10 may be configured for use in a lavatory to dispense water within the sink basin 14.

The faucet 10 illustratively includes an escutcheon or trim 16, and a delivery spout 18. The delivery spout 18 includes a body 20 illustratively coupled to the sink deck 12 in a conventional manner, such as a threaded rod 22 threadably receiving a retainer 24 to essentially clamp the faucet 10 to the sink deck 12 (FIG. 2).

A valve, illustratively a conventional mixing valve 26 is coupled to the delivery spout 18. Hot and cold water supply tubes 28 and 30 are fluidly coupled to inlets (not shown) of the valve 26, while an outlet tube or liner 32 is fluidly coupled to an outlet (not shown) of the valve 26. The outlet tube 32 supplies water to an outlet 33 of the delivery spout 18. Illustratively, the outlet tube 32 extends downwardly from an outlet port of the mixing valve 26 below the sink deck 12 and then loops back upwardly through the delivery spout 18 to the outlet 33. As is known in the art, operation of a lever or handle 34 of the valve assembly 26 adjusts the flow rate and temperature of water supplied to the outlet 33. The tubes 28, 30 and 32 are illustratively flexible and may be formed of a polymer, such as polyethylene.

Figure 3A:
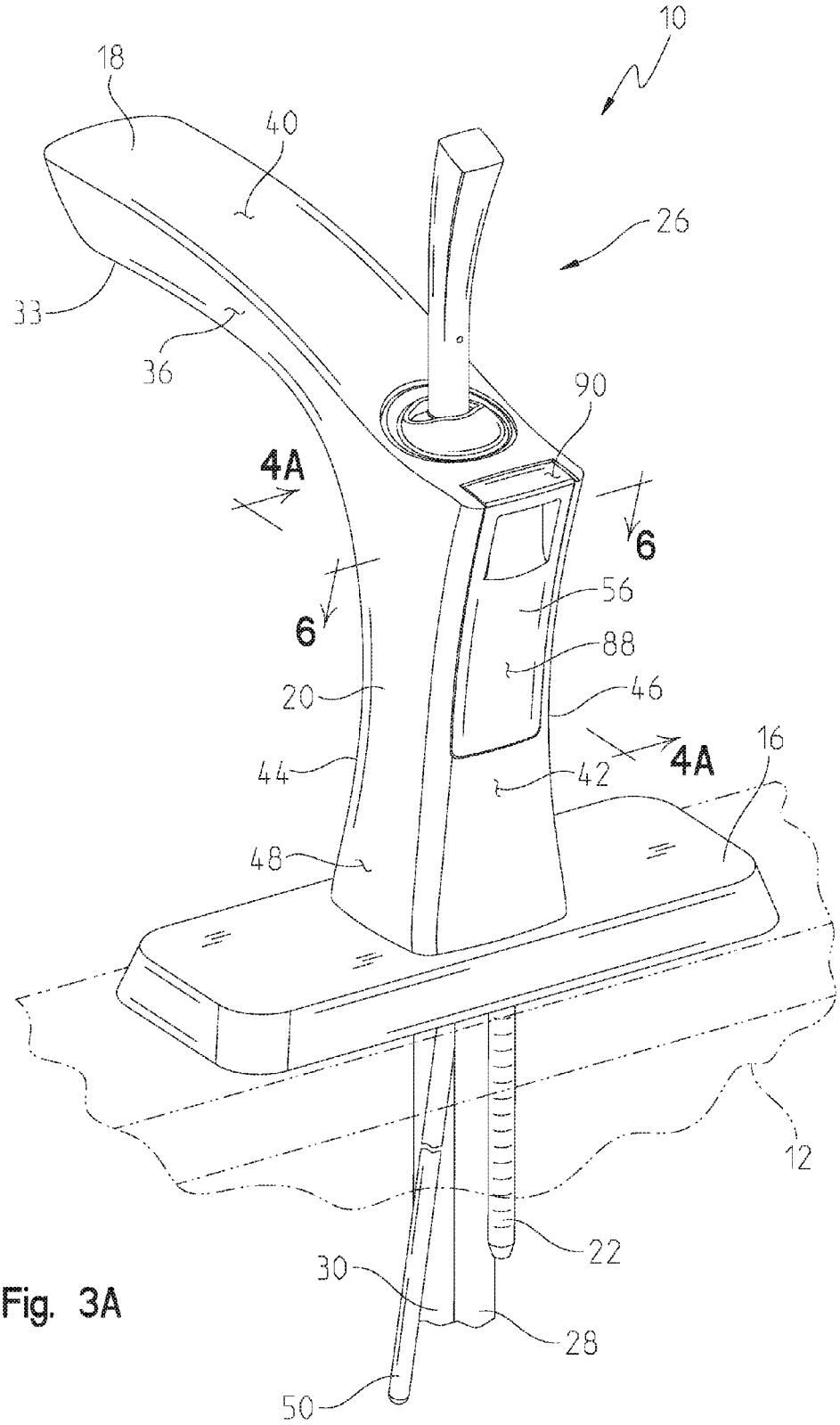
FIG. 3A is a rear perspective view of the faucet of FIG. 1, showing the lift rod and the finial in a lowered position.
Figure 3B:
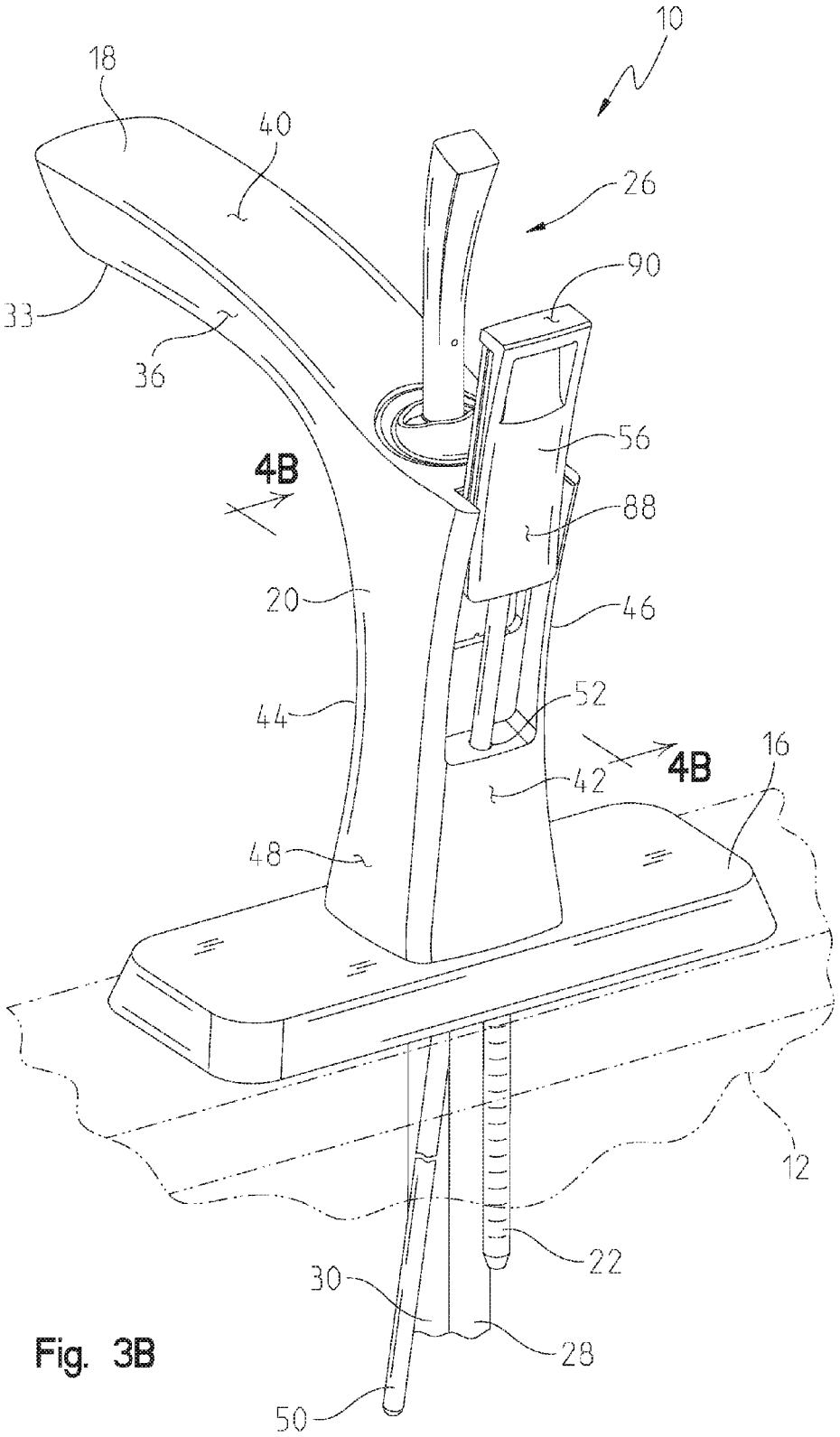
FIG. 3B is a rear perspective view similar to FIG. 3A, showing the lift rod and the finial in a raised position.

With reference to FIGS. 2-3B, the body 20 of the delivery spout 18 includes an outer surface 36 defining an outer or dimensional envelope 38 (FIG. 2). The outer surface 36 includes an upper surface 40, a rear surface 42, a front surface 44 and side surfaces 46 and 48.

With reference to FIGS. 2-4B, a pull or lift rod 50 is slidably received within an internal lift rod passageway 52 defined within the delivery spout 18. An upper end 54 of the lift rod 50 is threadably coupled to a knob or finial 56, while a lower end 58 of the lift rod 50 is illustratively coupled to a pop-up drain assembly 60 (FIG. 2).

With further reference to FIG. 2, the lift rod 50 is operably coupled to a lever or pivot arm 62 of the pop-up drain assembly 60 through a coupler 64. The pivot arm 62 is configured to pivot about a pivot seat 66 in order to raise and lower a drain stopper or plug 68 coupled to the pivot arm 62. More particularly, the pivot seat 66 includes a truncated ball 69 supported for pivoting movement about a pivot nut 70 and cooperating pivot base 72. The plug 68 is received within a flange 74 supported by the sink basin 14. The flange 74 is in communication with a tubular drain body 76 which is in fluid communication with a tail piece 78 for coupling to a conventional drain pipe (not shown).

Figure 5:
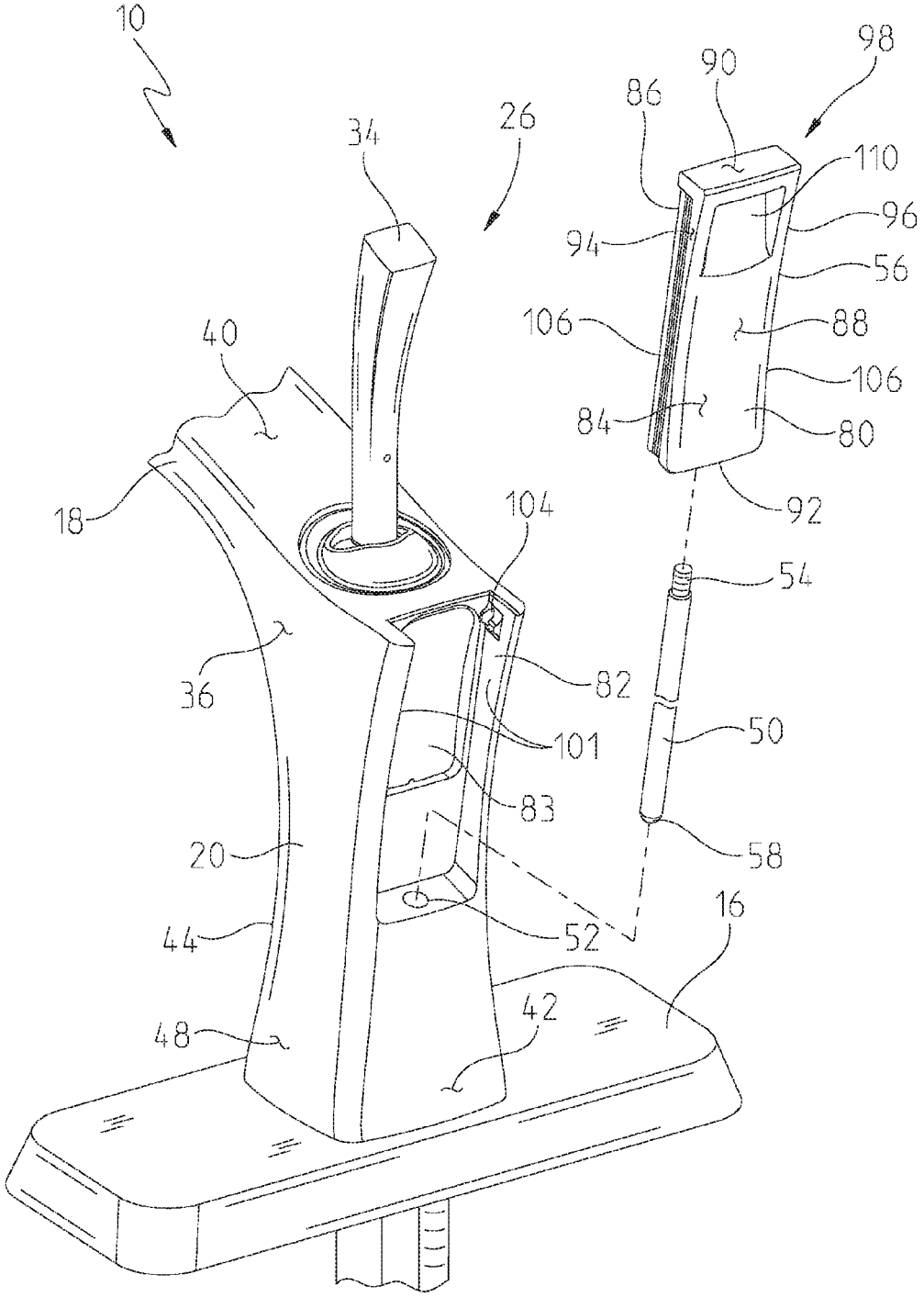
FIG. 5 is a partially exploded rear perspective view of the faucet of FIG. 1.
Figure 6:
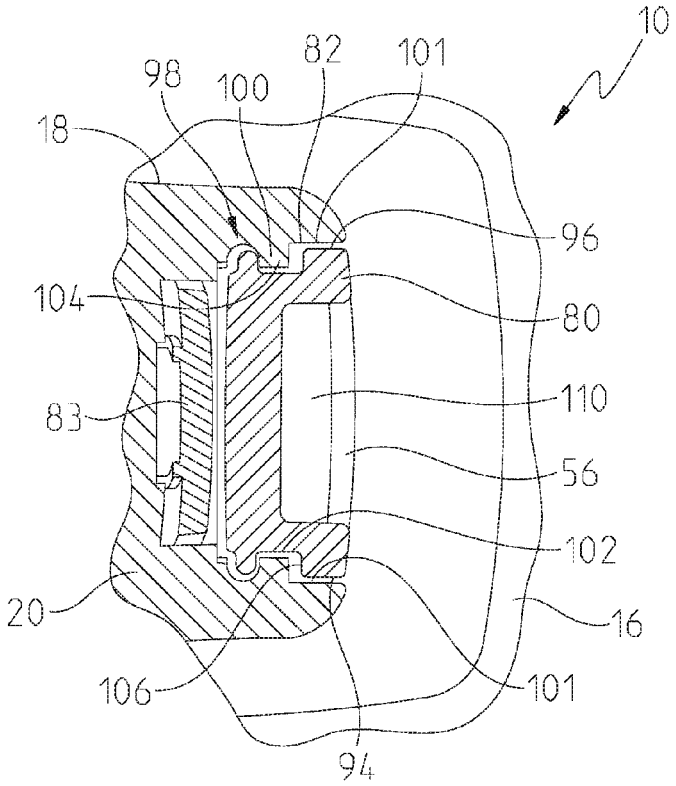
FIG. 6 is a cross-sectional view taken along line 6-6 of FIG. 3A.
Figure 7:
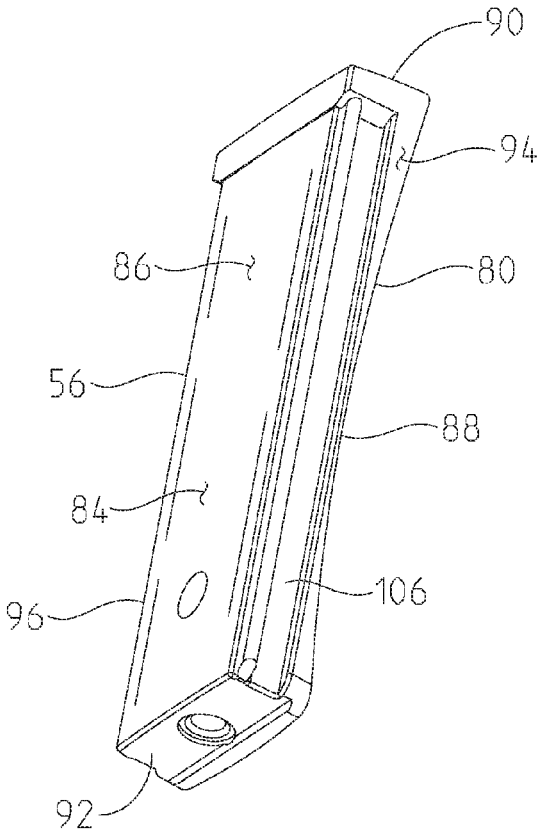
FIG. 7 is a perspective view of the finial of the faucet of FIG. 1.

With reference to FIGS. 5-7, the finial 56 includes a body 80 that is slidably received within a slot 82 formed in the delivery spout 18 for movement with the lift rod 50 between a lowered position and a raised position. The slot 82 is illustratively formed within the rear surface 42 of the delivery spout 18 and opens rearwardly. A cover 83 is illustratively supported by the delivery spout 18 and illustratively defines a front wall separating the valve 26 from the slot 82. The body 80 of the finial 56 includes an outer surface 84 defined by a front surface 86, a rear surface 88, an upper surface 90, a lower surface 92 and side surfaces 94, 96. The outer surface 84 of the finial 56 may be formed to appear similar to the outer surface 36 of the delivery spout 18. For example, the final 56 and the delivery spout 18 may include similar surface coatings or platings.

A guide device 98 includes a first guide member 100 supported by the delivery spout 18, and a second guide member 102 supported by the finial 56. The guide device 98 guides the finial 56 in sliding movement within the slot 82 of the delivery spout 18. Illustratively, the first guide member 100 comprises a pair of guide tabs 104 supported by opposing side walls 101 of slot 82 of the delivery spout 18. The second guide member 102 comprises a pair of guide tracks or slots 106 formed within opposing sides surfaces 94, 96 of the finial 56.

A user interface, illustratively a recess 110 is formed within the rear surface 88 of the finial 56 to accommodate a user's finger to assist in raising and lowering the finial 56 and the lift rod 50.

Figure 4A:
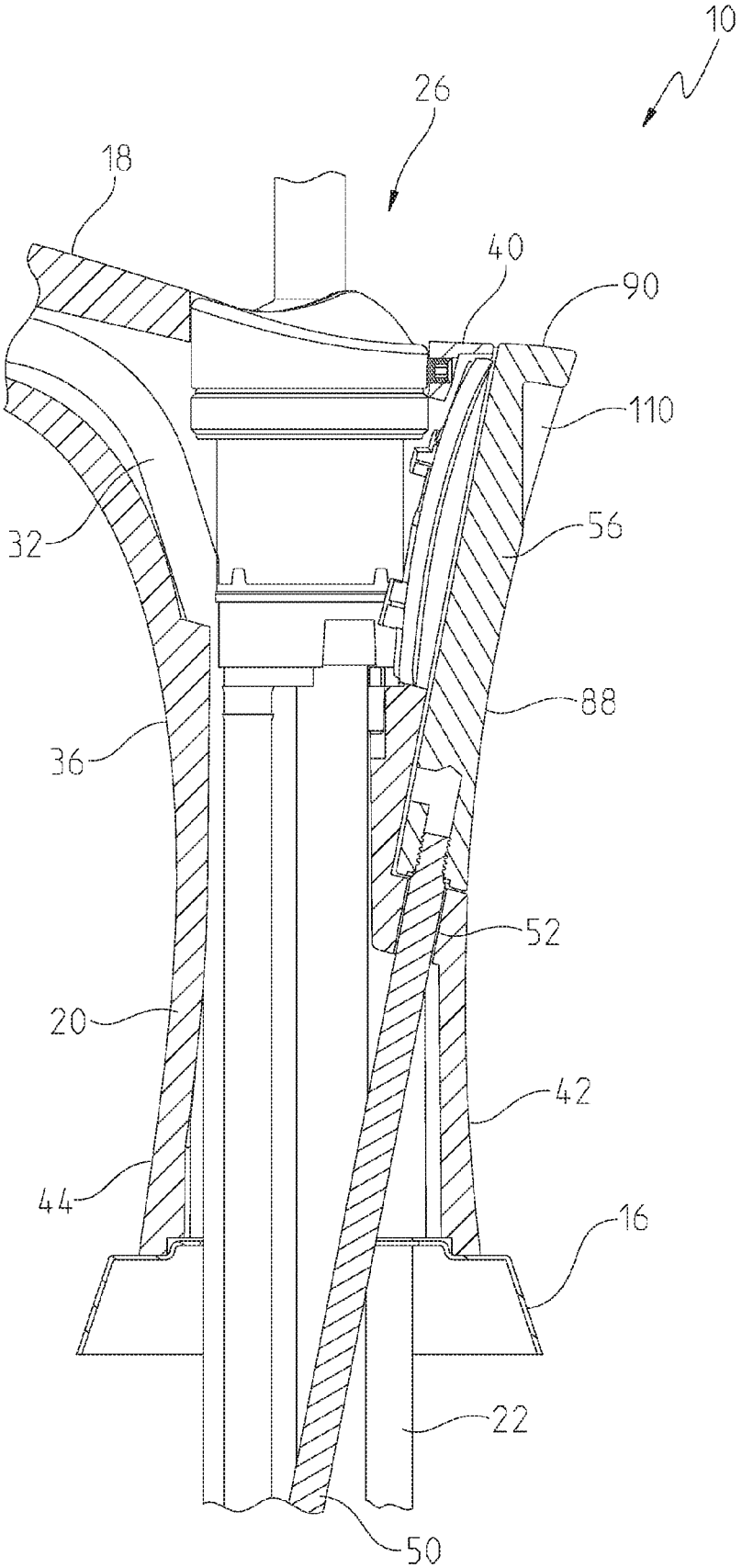
FIG. 4A is a cross-sectional view taken along line 4A-4A of FIG. 3A.
Figure 4B:
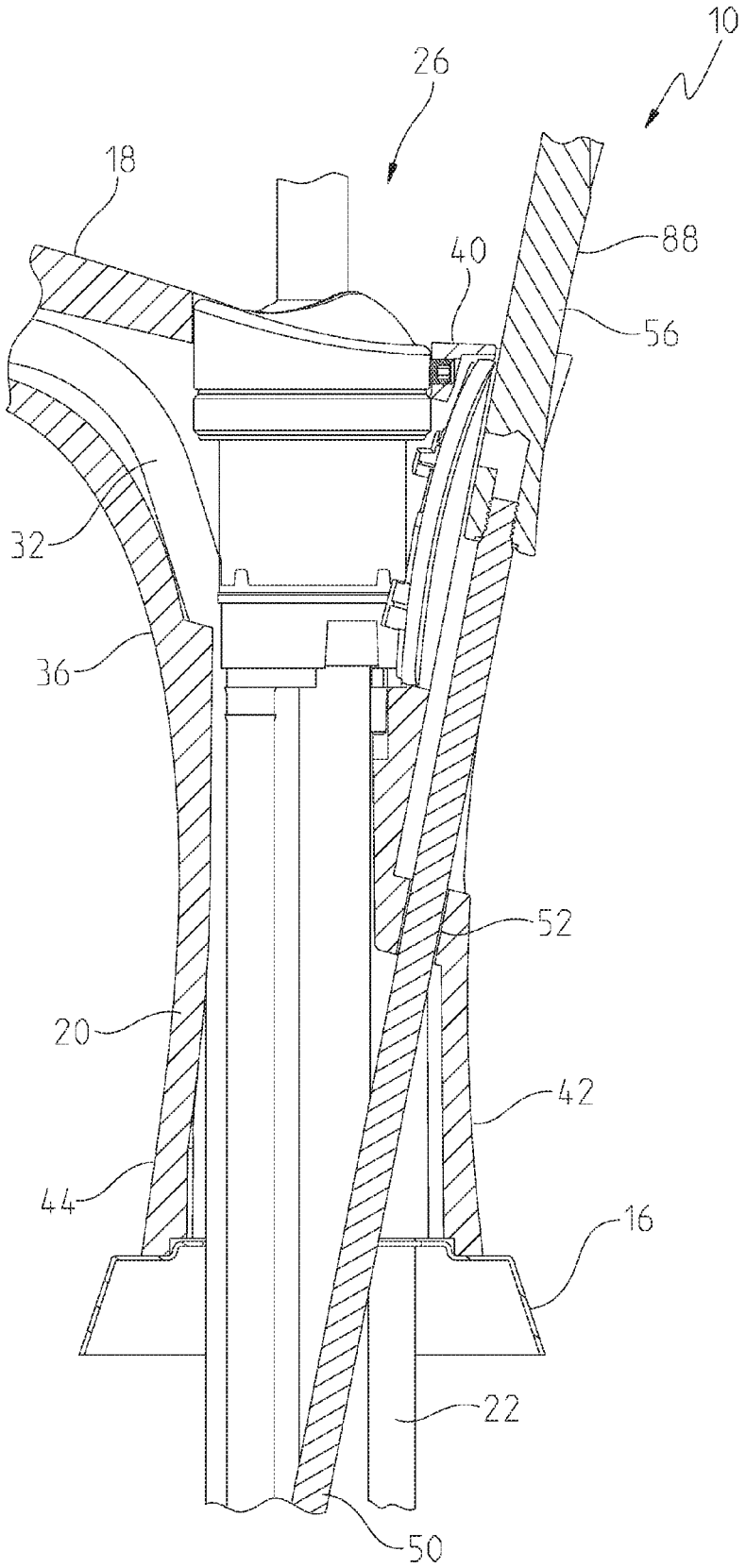
FIG. 4B is a cross-sectional view taken along line 4B-4B of FIG. 3B.

In operation, lifting or pulling up on the finial 56 moves the lift rod 50 from a lowered position (FIGS. 3A and 4A) to a raised position (FIGS. 3B and 4B). In response, the coupler 64 and the pivot arm 62 pivot upwardly in the direction of arrow 112 (FIG. 2). The pivot arm 62 pivots about the pivot seat 66, thereby causing downward movement of the plug 68 in the direction of arrow 114. Pushing down on the raised finial 56 lowers the lift rod 50. In response, the coupler 64 and the pivot arm 62 pivot downwardly in the direction of arrow 116. The pivot arm 62 pivots about the pivot seat 66, thereby causing upward movement of the plug 68 in the direction of arrow 118.

As shown in FIGS. 3A and 4A, when the lift rod 50 and the finial 56 are in the lowered position, the drain plug 68 is raised such that the drain assembly 60 is open. In this position, the finial 56 conforms to the shape of the outer surface 36 of the delivery spout 18. More particularly, the outer surface 84 of the finial 56 is positioned within the outer envelope 38 of the delivery spout 18. Moreover, the upper surface 90 of the finial 56 does not extend above (e.g., is flush with or below) the upper surface 40 of the delivery spout 18. Likewise, the rear surface 88 of the finial 56 does not extend beyond the rear surface 42 of the delivery spout 18.

With reference to FIGS. 3B and 4B, as the lift rod 50 and finial 56 are in the raised position, the drain plug 68 is lowered such that the drain assembly 60 is closed. In this position, the finial 56 extends outside of the shape of the outer surface 36 of the delivery spout 18. More particularly, the outer surface 84 of the finial 56 extends outwardly from the outer envelope 38 of the delivery spout 18. Moreover, the upper surface 90 of the finial 56 extends above the upper surface 90 of the delivery spout 18.

Although the invention has been described in detail with reference to certain preferred embodiments, variations and modifications exist within the spirit and scope of the invention as described and defined in the following claims.

The invention claimed is:

1. A faucet comprising:

a delivery spout configured to be coupled to a mounting deck, the delivery spout including an upper surface and an outlet for dispensing water;

a lift rod supported by the delivery spout for movement between a lowered position and a raised position, the lift rod including an upper end and a lower end; and a finial coupled to the upper end of the lift rod and including an upper surface, the upper surface of the finial supported above the upper surface of the delivery spout when the lift rod is in the raised position, and the upper surface of the finial supported flush with or below the upper surface of the delivery spout when the lift rod is in the lowered position.

2. The faucet of claim 1, wherein the upper end of the lift rod is threadably coupled to the finial.

3. The faucet of claim 1, wherein the delivery spout includes a rear surface and a slot formed within the rear surface, the finial slidably received within the slot.

4. The faucet of claim 3, wherein the delivery spout includes a first guide member, and the finial includes a second guide member cooperating with the first guide member to guide the finial in sliding movement within the slot of the delivery spout.

5. The faucet of claim 4, wherein the first guide member comprises a guide tab, and the second guide member comprises a slot receiving the guide tab.

6. The faucet of claim 3, wherein the finial includes a rear surface configured to conform to the rear surface of the delivery spout when the lift rod is in the lowered position.

7. The faucet of claim 6, wherein the rear surface of the finial is arcuate.

8. The faucet of claim 3, wherein the finial includes a rear surface including a user input recess configured to receive a finger of a user for raising the lift rod.

9. The faucet of claim 1, further comprising a drain assembly including a drain plug operably coupled to the lift rod such that movement of the lift rod causes corresponding movement of the drain plug.

10. A faucet comprising:

a delivery spout configured to be coupled to a mounting deck, the delivery spout including an outer surface defining an outer envelope;

a lift rod supported by the delivery spout for movement between a lowered position and a raised position, the lift rod including an upper end and a lower end; and a finial coupled to the upper end of the lift rod and including an outer surface, the outer surface of the finial extending outside of the outer envelope of the delivery spout when the lift rod is in the raised position, and the outer surface of the finial supported within the outer envelope of the delivery spout when the lift rod is in the lowered position;

wherein the outer surface of the finial includes a rear surface and an upper surface, the rear surface having a user input recess spaced intermediate the upper end of the lift rod and the upper surface of the finial.

11. The faucet of claim 10, wherein the upper end of the lift rod is threadably coupled to the finial.

12. The faucet of claim 10, wherein the outer surface of the delivery spout includes a rear surface and a slot formed within the rear surface, the finial slidably received within the slot.

13. The faucet of claim 12, wherein the delivery spout includes a first guide member, and the finial includes a second guide member cooperating with the first guide member to guide the finial in sliding movement within the slot of the delivery spout.

14. The faucet of claim 13, wherein the first guide member comprises a guide tab, and the second guide member comprises a slot receiving the guide tab.

15. The faucet of claim 12, wherein the outer surface of the finial includes a rear surface configured to conform to the rear surface of the delivery spout when the lift rod is in the lowered position.

16. The faucet of claim 15, wherein the rear surface of the body of the finial is arcuate.

17. The faucet of claim 12, wherein the user input recess is configured to receive a finger of a user for raising the lift rod.

18. The faucet of claim 10, further comprising a drain assembly including a drain plug operably coupled to the lift rod such that movement of the lift rod causes corresponding movement of the drain plug.

19. A faucet comprising:

a delivery spout configured to be coupled to a mounting deck, the delivery spout including an upper surface, a rear surface, a slot formed within the rear surface, and an outlet for dispensing water;

a lift rod supported by the delivery spout for movement between a lowered position and a raised position, the lift rod including an upper end and a lower end; and a finial coupled to the upper end of the lift rod, the finial slidably received within the slot of the delivery spout;

wherein the finial is fully received within the slot when the lift rod is in the lowered position, and extends outwardly from the slot when the lift rod is in the raised position;

wherein the outer surface of the finial includes a rear surface flush with a rear surface of the delivery spout and an upper surface, the rear surface having a user input recess spaced intermediate the upper end of the lift rod and the upper surface of the finial.

20. The faucet of claim 19, wherein the finial includes an upper surface and a rear surface, the upper surface of the finial being supported above the upper surface of the delivery spout when the lift rod is in the raised position, and the upper surface of the finial being supported flush with or below the upper surface of the delivery spout when the lift rod is in the lowered position.

21. The faucet of claim 20, wherein the rear surface of the finial is configured to conform to the rear surface of the delivery spout when the lift rod is in the lowered position.

22. The faucet of claim 21, wherein the rear surface of the finial is arcuate.

23. The faucet of claim 20, wherein the user input recess is configured to receive a finger of a user for raising the lift rod.

24. The faucet of claim 19, wherein upper end of the lift rod is threadably coupled to the finial.

25. The faucet of claim 19, wherein the delivery spout includes a first guide member, and the finial includes a second guide member cooperating with the first guide member to guide the finial in sliding movement within the slot of the delivery spout.

26. The faucet of claim 25, wherein the first guide member comprises a guide tab, and the second guide member comprises a slot receiving the guide tab.

27. The faucet of claim 19, further comprising a drain assembly including a drain plug operably coupled to the lift rod such that movement of the lift rod causes corresponding movement of the drain plug.

28. A faucet comprising:

a delivery spout configured to be coupled to a mounting deck, the delivery spout including an upper surface, a rear surface, a slot formed within the rear surface, and an outlet for dispensing water;

a lift rod supported by the delivery spout for movement between a lowered position and a raised position, the lift rod including an upper end and a lower end; and a finial coupled to the upper end of the lift rod, the finial slidably received within the slot of the delivery spout;

wherein the finial is fully received within the slot when the lift rod is in the lowered position, and extends outwardly from the slot when the lift rod is in the raised position;

wherein the finial includes an upper surface and a rear surface, the upper surface of the finial being supported above the upper surface of the delivery spout when the lift rod is in the raised position, and the upper surface of the finial being supported flush with or below the upper surface of the delivery spout when the lift rod is in the lowered position.

* * * * *